United States Patent [19]

Boggs et al.

[11] 3,964,722

[45] June 22, 1976

[54] TRANSFER TAIL APPARATUS AND METHOD FOR VERTICAL SPINDLE WINDER

[75] Inventors: Beryl Aaron Boggs, Chester; Robert David Carr, Hopewell; Lawrence Edward Cary, Richmond; Clarence Albert Forman, Hopewell; Wayne Henry Murray, Chester; Weldon Herbert Peterson, Colonial Heights; Everett Gray Montgomery, Chester, all of Va.

[73] Assignee: Allied Chemical Corporation, Petersburg, Va.

[22] Filed: June 3, 1974

[21] Appl. No.: 475,365

[52] U.S. Cl. ..... 242/18 PW; 57/34 TT

[51] Int. Cl.[2] ..... B65H 54/02

[58] Field of Search ..... 242/18 PW, 18 A, 18 R; 57/34 TT

[56] References Cited

UNITED STATES PATENTS

| | | | |
|---|---|---|---|
| 3,224,692 | 12/1965 | Nugent | 242/18 PW |
| 3,251,560 | 5/1966 | Macedo | 242/18 PW |
| 3,276,704 | 10/1966 | Pabis | 242/18 PW |
| 3,282,516 | 11/1966 | Porter | 242/18 PW |
| 3,550,871 | 12/1970 | Keith | 242/18 A |
| 3,672,582 | 6/1972 | Allam et al. | 242/18 PW X |
| 3,777,996 | 12/1973 | Torii | 242/18 PW X |

*Primary Examiner*—Stanley N. Gilreath
*Attorney, Agent, or Firm*—Richard A. Anderson

[57] ABSTRACT

The transfer tail apparatus of this invention comprises a tail forming string-up aid, a tail cutter, and tail storage mechanism. The method is to form the tail as the yarn is traveling from a supply source around a spool of the spring-loaded string-up aid to an aspirator which has an internal tail cutter. After the winder has started, and the rotating bobbin flange, which has a pin attached underneath and near the outer edge, reaches the desired speed, the spring-loaded string-up aid is manually released. The string-up aid springs upward to bring the yarn being aspirated to a position where the rotating bobbin pin engages the yarn. At this point, the yarn in the aspirator is reversed in direction and tension is applied to the yarn across the internal cutter which cuts the yarn. The string-up aid and tail cutter are located so that when the yarn has been cut and the direction is reversed, the yarn is directed into a tail storage slot underneath the bobbin flange. When the bobbin is removed, the slot no longer exists and the tail may be easily used. This apparatus and method allow formation of the tail of the inside end of the yarn which is preserved undamaged and extends from the inside of the full package to allow a junction between the tail and the head of another package to be processed.

13 Claims, 5 Drawing Figures

TRANSFER TAIL APPARATUS AND METHOD FOR VERTICAL SPINDLE WINDER

BACKGROUND OF THE INVENTION

This invention relates to winding yarn, more particularly to an apparatus and method to form a transfer tail, during initial string-up on a winder, preferably on a vertical spindle winder.

This invention is particularly adapted for use in conjunction with the improved vertical spindle winder disclosed in U.S. Ser. No. 459,429, filed Apr. 9, 1974, hereby incorporated by reference in toto.

It is known in the prior art to store a transfer tail on a storing drum beneath the bobbin as in U.S. Pat. No. 3,648,939, and it is also known to use an aspirator during string-up to bring yarn across the initial contact area for yarn storage prior to bobbin winding, as in U.S. Pat. No. 3,777,996, FIG. 1, items 19 and 20, hereby incorporated by reference. However, the prior art methods were not adequate for applicants' specific application, and many string-ups with no tails or bad tails resulted. With undrawn yarn, the tails were stretched or drawn and unusable.

SUMMARY OF THE INVENTION

The apparatus of this invention for forming a transfer tail during string-up of a winder for winding yarn on a bobbin having a flange comprises in combination (1) a thrustable preferably spring-loaded, tail-forming string-up aid, (2) a tail storage mechanism, and (3) a tail cutter. The aid is located adjacent to the outer edge of the periphery of the flange of the bobbin. The storage mechanism is located adjacent to the outer face of the flange but inside the outer edge of the periphery of the flange. By outer face of the bobbin flange is meant the face away from the yarn being wound to form a package. By inside face of the bobbin flange is meant the face of the bobbin flange adjacent to the yarn being wound into a package. The thustable string-up aid is preferably spring-loaded but could be thrust outwardly by other means such as a quick-acting fluid cylinder, either air or hydraulic, or by a solenoid. The tail cutter is located adjacent to the winder at a distance from the aid. The cutter must be downstream from the string-up aid, that is, as the yarn passes across the inside of the bobbin flange to the string-up aid, then across the outer face of the bobbin flange, the cutter must be located to contact the yarn after it crosses the outer face of the bobbin flange. The string-up aid has a thrustable or locked, spring-loaded position and an activated position. The activated position is located so as to cause the yarn to be brought into contact with and be stored upon the storage mechanism as a tail. The activated position also brings about winding which in conjunction with yarn storage winding activates the tail cutter. Preferably, the tail cutter is located internally in an aspirator exhaust conduit. Particularly preferred is a cutter which is a sharp edge located internally midway in an elbow of an aspirator conduit. The cutter can be activated by the reversed direction of the yarn travel causing tension on the yarn to bring it into contact with the sharp edge, thereby cutting the yarn. The yarn cutter can be located at a distance into the aspirator conduit sufficient to provide the desired tail length. Other equivalent means, such as solenoid activated cutters, could be used, also.

The preferred storage mechanism comprises the outer face of the bobbin flange, a mating winder flange, and a waste collar. The bobbin flange preferably would have a pin for catching yarn near the outer periphery. Particularly preferred is a bobbin flange and a waste collar which form an annular cavity at the periphery of the winder flange. Even more preferred is when the winder flange has a smaller diameter than the bobbin flange.

A preferred string-up aid comprises a spool, a plunger, a compression spring, a stationary mounting for the compression spring, a lever, a spool shaft, and a transverse plunger pin. The spool is rigidly attached transversely to one end of the plunger by the spool shaft. One end of the compression spring is restrained by or attached to the transverse plunger pin spaced apart from the spool shaft on the plunger. The other end of the compression spring is restrained by or attached to the stationary mounting. The pin is held in locked position by the lever. The lever is positioned so as to release the spring from a locked position to move the plunger and the spool to the activated position. The stationary mounting can be a housing having a longitudinal slot to allow the pin to pass through and move from the locked to activated position by release of the lever. The lever can be returned by an extension spring to the locked position. The method of this invention is to string-up a flanged bobbin winder with a spring-loaded string-up aid, a tail storage mechanism and a tail cutter so as to form a transfer tail of yarn to be wound. The method is (a) passing yarn to be wound across the inside face of the bobbin flange then over the string-p aid in a locked position and across the outside face of the bobbin flange to the cutter; then (b) activating the spring-loaded string-up aid to an activated position to cause the yarn to begin (c) contacting the tail storage mechanism and (d) winding the yarn on the bobbin and (e) cutting the yarn at a distance downstream of the string-up aid and (f) storing the yarn in the tail storage mechanism, then (g) ceasing to wind the yarn on the bobbin, then (h) removing the bobbin from the winder and finally (i) removing the tail from the remaining portion of the storage mechanism; to provide a wound bobbin having a transfer tail from the first wound yarn. In th preferred method, the yarn is a continuous running length and step (b) causes reversal of direction of movement of the yarn by step (d) which in turn causes step (e) to occur. The reversal of movement of yarn takes place only between where it engages a pin, or other engaging means adjacent the storage mechanism, and where it is cut. This is the yarn that is stored as a tail on the storage mechanism.

The apparatus and method of this invention has been successful to form good tails and prevent string-ups having no tails or bad tails. It has been particularly successful with forming good, unstretched tails when winding undrawn yarn.

PREFERRED EMBODIMENTS

Figure 1:
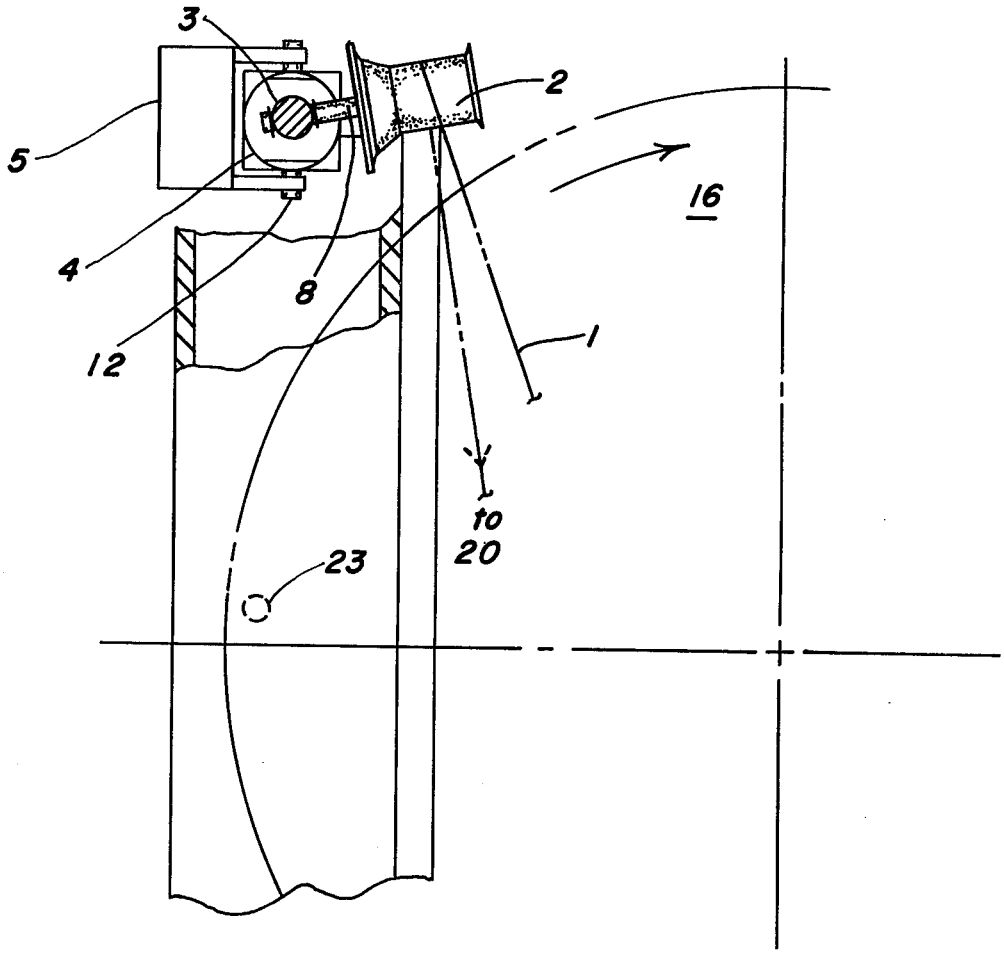
FIG. 1 is a plan view of the string-up aid of this invention.

FIG. 1 is a plan view of the string-up aid of this invention. Yarn 1 passes over spool 2 which is attached to plunger 3 by shaft 8. Also shown are housing 4 and lever 5. Pin 12 is spaced apart from shaft 8 mounted transverse to the plunger, extending through slot in housing 4 and engaged by lever 5. Bobbin flange 16 having pin 23 on the outer face is also shown.

Figure 2:
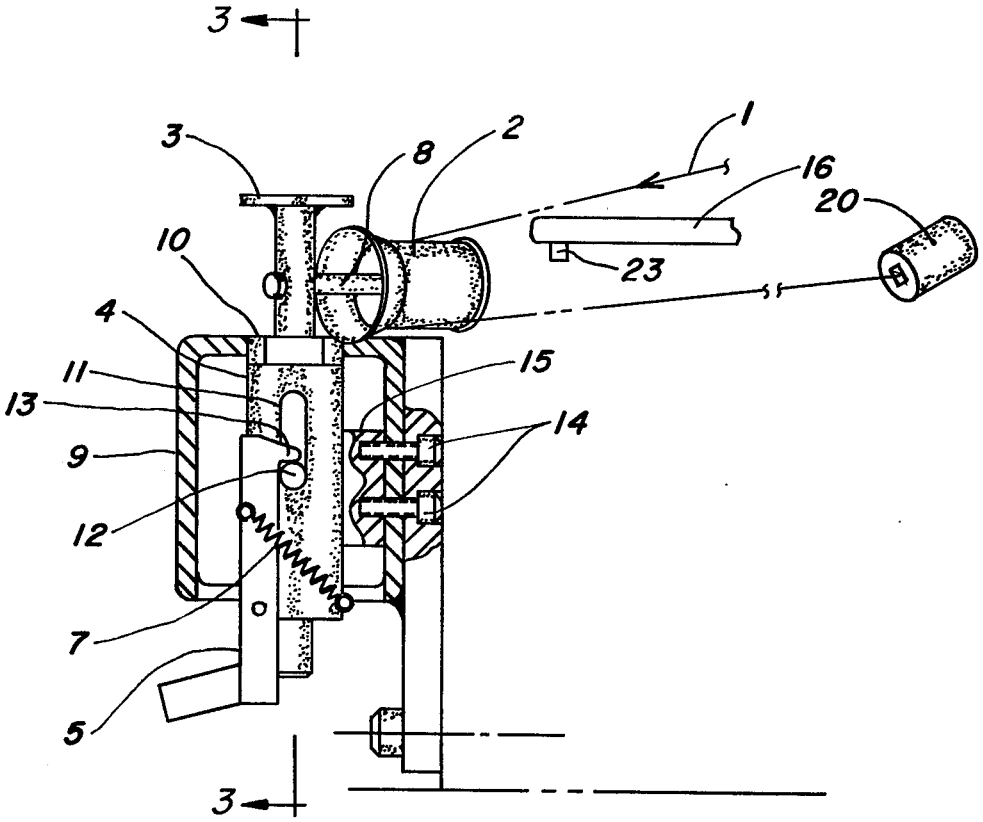
FIG. 2 is a partial cross-section elevation view of the string-up aid of this invention.

FIG. 2 is a partial cross-section view of the elevation of the string-up aid of this invention. Yarn 1 passes across the inner face of bobbin flange 16 to spool 2 and the across the outer face of flange 16 to aspirator 20. Spool 2 is connected to plunger 3 by shaft 8 transversely and rigidly as shown. Spaced apart from shaft 8 is pin 12 also transverse to plunger 3 which passes through slot 11 in housing 4. Plunger 3 passes through bushing 10 to housing 4. Bushing 10 is mounted in winder member 9. Housing 4 is rigidly attached to member 9 by means of screws 14 into projection 15. Lever 5 locks pin 12 with lugs 13. Extension spring 7 returns lever 5 to the locked position. To move string-up aid to the active position, lever 5 is pressed at a point away from lugs 13 which moves lugs 13 to release pin 12 which is urged upwardly by spring 6 shown in FIG. 3 to thrust spool 2 rapidly upwardly so that yarn 1 engages pin 23 and reverses direction if it is a continuously running length of yarn being aspirated by aspirator 20. This reversal of direction of yarn 1 takes place only between pin 23 and cutter 21 (shown in FIG. 5) in aspirator 20. This length of yarn 1 between pin 23 and cutter 21 is wound on the storage mechanism (shown in FIG. 4) as the tail.

Figure 3:
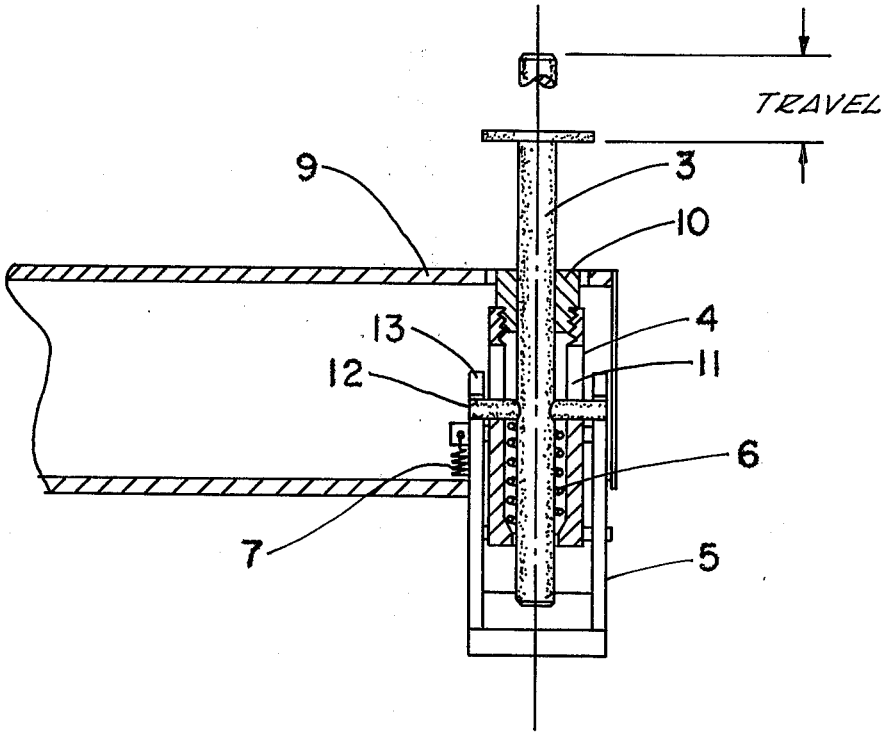
FIG. 3 is Section 3—3 shown across FIG. 2.

FIG. 3 is a cross-section indicated 3—3 on FIG. 2. Plunger 3 is shown passing through bushing 10 in winder housing 9 into spring housing 4 containing compression spring 6 which urges transverse pin 12 upwardly. Compression spring 6 is restrained by pin 12 at one end and by housing 4 at the other end. Lever 5 holds pin 12 in the locked position with lugs 13. On release by lever 5, lugs 13 move to release pin 12 to slide or thrust upwardly in slot 11 in housing 4. Extension spring 7 returns lever 5 to a locked position pressing down on plunger 3 returns the string-up aid to a locked position.

Figure 4:
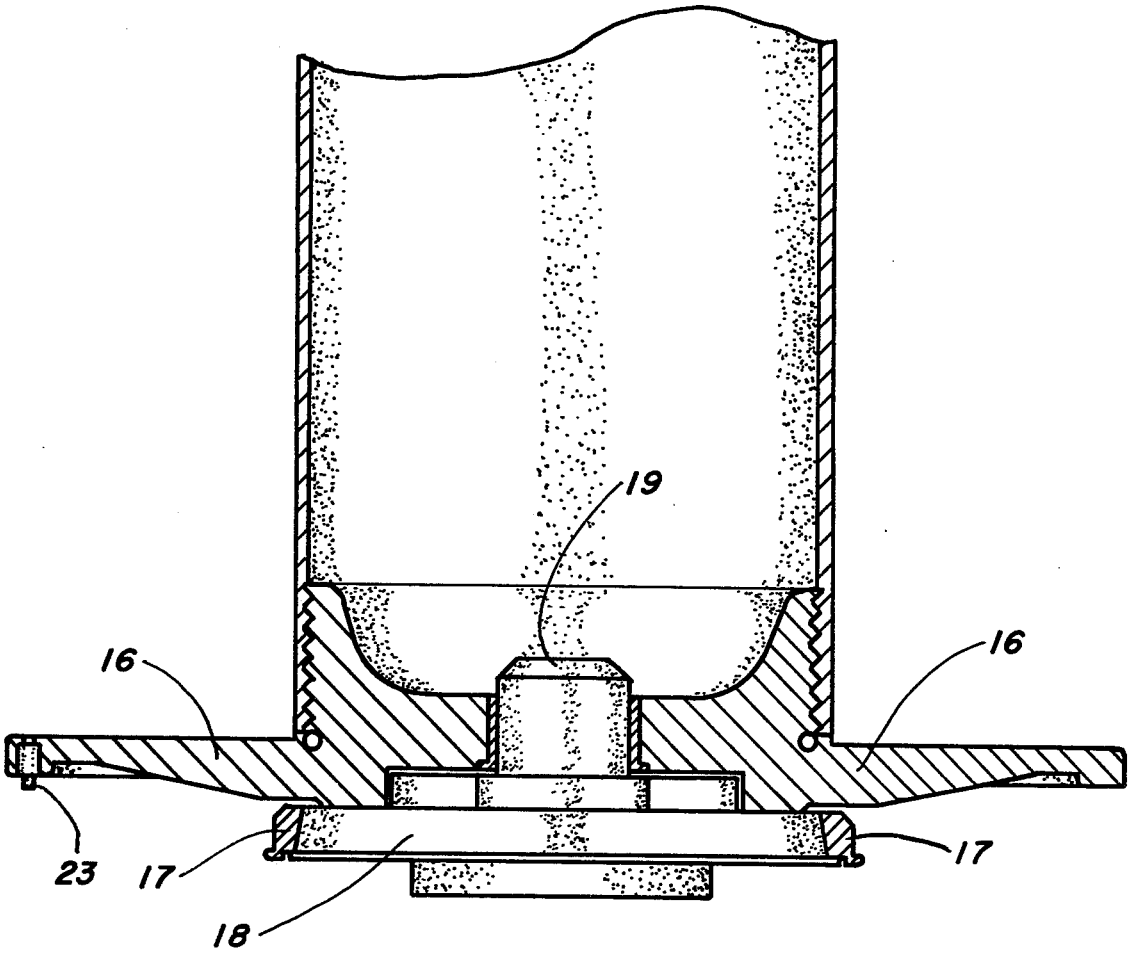
FIG. 4 is a cross-section elevation view of the tail storage mechanism of this invention.

FIG. 4 is a cross-section elevation view showing the tail storage mechanism of this invention. Bobbin flange 16 mates with winder flange 18 over hub 19. Waste collar 17 surrounds the periphery of winder flange 18. An annular cavity or slot is formed at the periphery of the winder flange by the top of the waste collar 17. The top of the cavity is formed by the outer face of bobbin flange 16.

Figure 5:
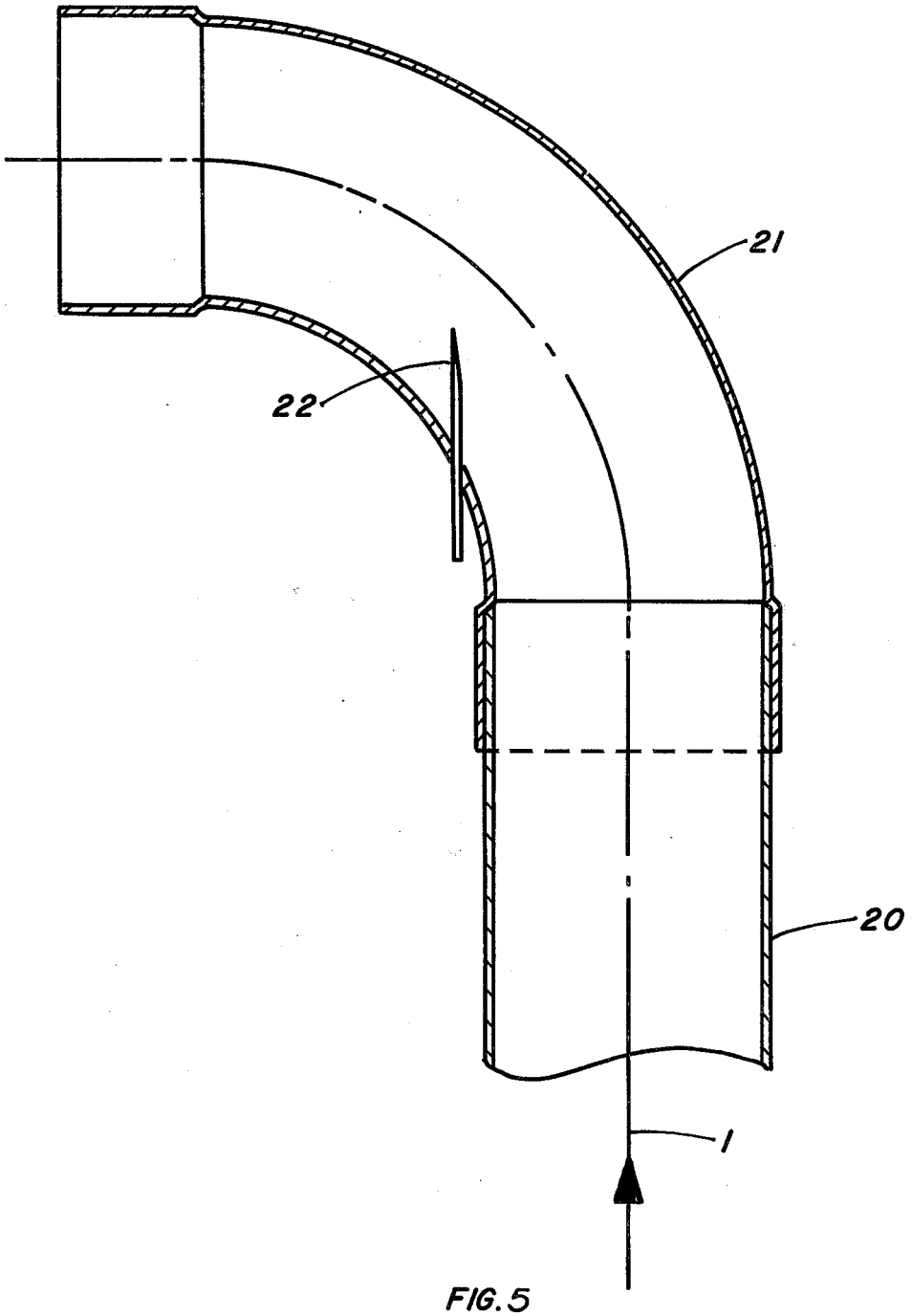
FIG. 5 shows the cutter of this invention.

FIG. 5 is a cross-section view of the aspirator exhaust conduit 20 and cutter 22 in elbow 21 of this invention. Cutter 22 is mounted midway in elbow 21. When yarn 1 reverses direction, it is drawn with tension across knife edge cutter 22 to cut the yarn. The aspirator mechanism within conduit 20 can be any conventional yarn aspirator. When the yarn 1 engages pin 23, it causes tension in yarn 1 across cutter 22 thereby cutting the yarn 1 across the knife edge of cutter 22, reversing the yarn 1 in direction between pin 23 and cutter 22 and pulling a portion of yarn from aspirator to wind on the yarn storage mechanism shown in FIG. 4.

We claim:

1. An apparatus for forming a transfer tail during string-up of a winder for winding yarn on a bobbin having a flange comprising in combination a thrustable, tail forming string-up aid, a tail storage mechanism, a pin at the outer edge of the outer face of said flange, a tail cutter, and means to thrust said aid, said aid being located adjacent to the outer edge of the periphery of said flange of said bobbin said storage mechanism being locate adjacent to the outer face of said flange of said bobbin and inside the outer edge of the periphery of said flange said tail cutter being located adjacent said winder, but at a distance dowstream from said aid, said yarn passing across the inside of said bobbin flange to said string-up aid, then across the outer face of said bobbin flange, said cutter located to contact said yarn after said yarn crosses the outer face of the bobbin flange, said aid having a locked, thrustable position holding said yarn out of contact with said pin, flange and storage mechanism, and an activated position, said activated position being located so as to cause yarn to be brought into contact with said pin and storage upon said storage mechanism as a tail, and so as to activate said tail cutter by reversal of direction of yarn travel between said pin and said cutter, said activated position also bringing about winding of said yarn on said bobbin.

2. Apparatus of claim 1 wherein said means is a spring.

3. Apparatus of claim 1 wherein said tail cutter is located internally in an aspirator exhaust conduit, at a distance into said conduit sufficient to provide the desired tail length.

4. Apparatus of claim 2 wherein said cutter is a sharp edge located midway in an elbow of said conduit, and said cutter is activated by reversal of direction of yarn travel causing tension on yarn to bring it in contact with said sharp edge, thereby cutting said yarn.

5. Apparatus of claim 1 wherein said tail storage mechanism comprises the outer face of said bobbin flange, a mating winder flange and a waste collar, said bobbin flange having said pin for catching yarn near the outer periphery.

6. Apparatus of claim 5 wherein said bobbin flange and said waste collar form an annular cavity at the periphery of the winder flange.

7. Apparatus of claim 6 wherein said winder flange has a smaller diameter than said bobbin flange.

8. Apparatus of claim 7 wherein said string-up aid comprises a spool, a plunger, a compression spring, a stationary mount for compression spring, a lever, a spool shaft, and a transverse plunger pin, said spool rigidly attached transversely to one end of said plunger by said spool shaft, one end of said compression spring attached to said transverse plunger pin spaced apart from said spool on said plunger, the other end of said compression spring attached to said stationary mount, said pin held in locked position by said lever, said lever positioned so as to release said spring from said locked position to move said plunger and said spool to said activated position.

9. Apparatus of claim 8 wherein said stationary mount is a housing having a longitudinal slot to allow said pin to pass through and move from locked to activated position.

10. Apparatus of claim 8 wherein said lever is returned by an extension spring to said locked position.

11. The apparatus of claim 8 wherein said tail cutter is located internally in an elbow of an aspirator exhaust conduit at a distance into said conduit sufficient to provide the desired tail length, said cutter is a sharp edge and is activated by said reversal in direction of the yarn travel causing tension in the yarn to bring it in contact with the sharp edge, thereby cutting the yarn.

12. A method to string-up a flanged bobbin winder with a thrustable string-up aid, a pin at the outer edge of the outer face of said flange, a tail storage mechanism, and a tail cutter, so as to form a transfer tail of yarn to be wound comprising a. passing yarn to be wound across the inside face of said bobbin flange then over said string-up aid in a locked position and across said outer face of said bobbin flange to said cutter, then b. activating said spring-loaded string-up aid, to an activated position to cause said yarn to begin simultaneously
   1. contacting said pin and
   1. winding said yarn on said bobbin, and
   3. cutting said yarn at a distance downstream from said string-up aid, thus c. storing said yarn in said tail storage mechanism, said stored yarn being said yarn at a distance downstream from said string-up aid having been cut and reversed in direction between said cutter and said pin and wound on said storage mechanism, d. ceasing to wind said yarn on said bobbin, then e. removing said bobbin from said winder, and finally f. removing said tail from the remaining portion of the storage mechanism, to provide a wound bobbin having a transfer tail from the first wound yarn.

13. The method of claim 12 wherein said yarn is a continuous running length.

* * * * *